US005160193A

United States Patent [19]

Fabbri et al.

[11] Patent Number: 5,160,193

[45] Date of Patent: Nov. 3, 1992

[54] MODULAR MEDICAL LIGHT SYSTEM

[75] Inventors: William C. Fabbri, Billerica; Roy Crane, Wilmington, both of Mass.

[73] Assignee: Keene Corporation, Union, N.J.

[21] Appl. No.: 830,801

[22] Filed: Feb. 4, 1992

Related U.S. Application Data

[63] Continuation-in-part of Ser. No. 693,696, Apr. 30, 1991, Pat. No. 5,086,375, which is a continuation-in-part of Ser. No. 629,436, Dec. 18, 1990, Pat. No. 5,038,254.

[51] Int. Cl.[5] ..... F21V 13/00

[52] U.S. Cl. ..... 362/33; 362/225; 362/147; 362/240; 362/243; 362/282; 362/364; 362/801; 362/804

[58] Field of Search ..... 362/282, 33, 147, 225, 362/234, 243, 253, 303, 305, 343, 364, 216, 801, 804, 322, 365

[56] References Cited

U.S. PATENT DOCUMENTS 2,998,508 8/1961 Bobrick ..... 362/801 X
3,928,757 12/1975 Nelson ..... 362/804 X
4,204,274 5/1980 Lüderitz ..... 362/225 X
5,038,254 8/1991 Fabbri et al. ..... 362/804 X
5,086,375 2/1992 Fabbri et al. ..... 362/804 X

*Primary Examiner*—Stephen F. Husar
*Attorney, Agent, or Firm*—Kane, Dalsimer, Sullivan, Kurucz, Levy, Eisele and Richard

[57] ABSTRACT

The apparatus is a modular medical lighting system which includes a ceiling-mounted reading light module, examination light module, ambient light module, and a night light module. The reading light is directed toward a selected reading area on a hospital bed directly below the medical lighting system. The examination light illuminates the entire top surface of the hospital bed. The ambient light directs light to a wall abutting the head of the hospital bed thereby providing reflected light to the vicinity of the hospital bed. The night light directs light to a selected side of the bed so as to light a nurse's medical chart clipboard without disturbing the patient. The modules may be provided separately or in combination.

35 Claims, 11 Drawing Sheets

MODULAR MEDICAL LIGHT SYSTEM

This application is a continuation-in-part of U.S. patent application Ser. No. 07/693,696 filed Apr. 30, 1991 which is to issue on even date herewith as U.S. Pat. No. 5,086,375, which is, in turn, a continuation-in-part of U.S. patent application Ser. No. 07/629,436, filed Dec. 18, 1990, now U.S. Pat. No. 5,038,254.

BACKGROUND OF THE INVENTION

1. Field of the Invention

This invention pertains to a light system for use in hospitals and health facilities. The light system includes an examination light, an ambient light, a reading light, and a night light and is preferably mounted in the ceiling.

2. Description of the Prior Art

In hospitals and similar health or medical facilities, it is desirable to provide the bedridden patient with four types of lights—the first is an ambient light which provides background, preferably reflected, light to a large area surrounding the bed; the second is a reading light which provides direct light to a portion of the patient's bed; the third is an examination light which directs a high intensity light to substantially the entire area of the patient's bed; and the fourth is a night light which has a field adjustably directed to either the right or the left side of the patient's bed. The ambient light typically has an illumination value of approximately 50 foot-candles while the reading light typically has an illumination value of approximately 70 foot-candles and the examination light typically has an illumination value of approximately 100 foot-candles. The night light typically has an illumination value of approximately 30 to 40 foot-candles at a clipboard-sized area (typically a circular area about twelve to eighteen inches in diameter) about three to four feet from the ground on the side of the patient's bed.

Additionally, it is desirable to provide a reading light in which the patient and visitors are not exposed to any glare from the fixture regardless of whether the patient is lying flat, sitting up in a reading position, or reclining on the bed in any position in between the flat or reading position.

Moreover, it is desirable to provide an ambient light wherein an indirect light is bounced from the wall to provide light appropriate for the patient to relax, watch television, or receive visitors.

Similarly, it is desirable to provide an examination light in a down-light module that focuses light substantially within the length of the bed for examination of the patient by the medical staff. It is further desirable to provide such a light within a module which can be used individually or repeated as many times as necessary to achieve the level of light appropriate for the type of care being given. When more than one module is used, the modules could be switched separately to provide different intensities of light.

Moreover, it is desirable to provide a nurse's night light which focuses a narrow light to either side of the patient's bed so that a nurse is able read a medical chart, a clipboard or similar writing while standing beside the bed without disturbing the sleeping patient.

In the prior art, these lights were typically provided individually in a haphazard way. Different types of lamps and light fixtures were placed around the bed with numerous plugs competing with medical equipment for available outlet space. Moreover, such an arrangement was unsightly and could impede the mobility of the patient, the patient's bed, or the surrounding medical equipment.

Wall-mounted fixtures alleviated some of the above-identified deficiencies but still left much to be desired aesthetically and, more importantly, could impede access to the patient, and were easily damaged by motor driven bed headboards.

Additionally, in the prior art, medical lights have not been provided within modules so that different combinations of reading, ambient, examination and night lights could be incorporated into a single fixture.

OBJECTS AND SUMMARY OF THE INVENTION

It is therefore an object of this invention to provide a modular medical lighting system with a reading light module, an ambient light module, and an examination light module.

It is therefore a further object of this invention to provide a modular medical lighting system wherein the reading light module, the ambient light module and the examination light module can be combined within a standard-sized light fixture, used individually, or combined into pairs.

It is therefore a further object of this invention to provide a modular medical lighting system wherein the reading light does not expose the patient or visitors to glare regardless of whether the patient is lying flat, sitting up in a reading position, or reclining on the bed in any position in between the flat or reading position.

It is therefore a still further object of this invention to provide a modular medical lighting system including an ambient light wherein an indirect light is bounced from the wall to provide light appropriate for the patient to relax, watch television, or receive visitors.

It is therefore a still further object of this invention to provide a modular medical lighting system including an examination light in a down-light module that focuses light substantially within the length of the bed for examination of the patient by the medical staff.

It is therefore a still further object of this invention to provide a modular medical lighting system wherein the examination light is provided within a module which can be used individually or repeated as many times as necessary to vary the level of light.

It is therefore a final object of this invention to provide a modular medical lighting system including a night light that focuses light to the side of the bed so that a nurse can read a clipboard or medical charts without disturbing the patient.

These and other objects are effectively attained by providing a ceiling-mounted medical lighting system which includes four individual dedicated modular light fixtures. Preferably, one of each of the four modules are combined to form a lighting fixture which is designed to be placed so that one of the shorter ends of the rectangle is placed substantially on the ceiling-wall interface directly over the head of the patient's bed. The bed is placed so that the longer sides of the bed are parallel to the longer sides of the rectangular light fixture. However, the modules can be used individually or combined into pairs to provide a limited number of the above-identified functions.

A first modular light fixture includes a fluorescent bulb and a reflector designed to direct light toward the forward portion of the patient's bed so as to allow a patient to read comfortably. A second modular light fixture includes a fluorescent bulb and a reflector designed to direct light toward a vertical wall abutting the head of the patient's bed so as to provide a reflected light over a large area around the patient's bed. A third modular light fixture includes two to four fluorescent bulbs which are oriented perpendicularly to the bed. The fluorescent bulbs have a light distribution pattern which is substantially oriented in the direction perpendicular to the bulb. Therefore, the entire area of the bed is efficiently illuminated providing an examination light. A fourth modular light fixture includes a horizontal halogen bulb oriented above the ambient light fixture. A mirror reflects the light from the halogen bulb downwardly. The position of the mirror can be adjusted to direct the light to the left or right side of the bed.

The fluorescent bulbs in the reading, ambient and examination modules are preferably biax® or other U-shaped bulbs. The bulb in the night light module is preferably a 120 volt, medium base, narrow spot, 50–55 watt halogen reflector lamp.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
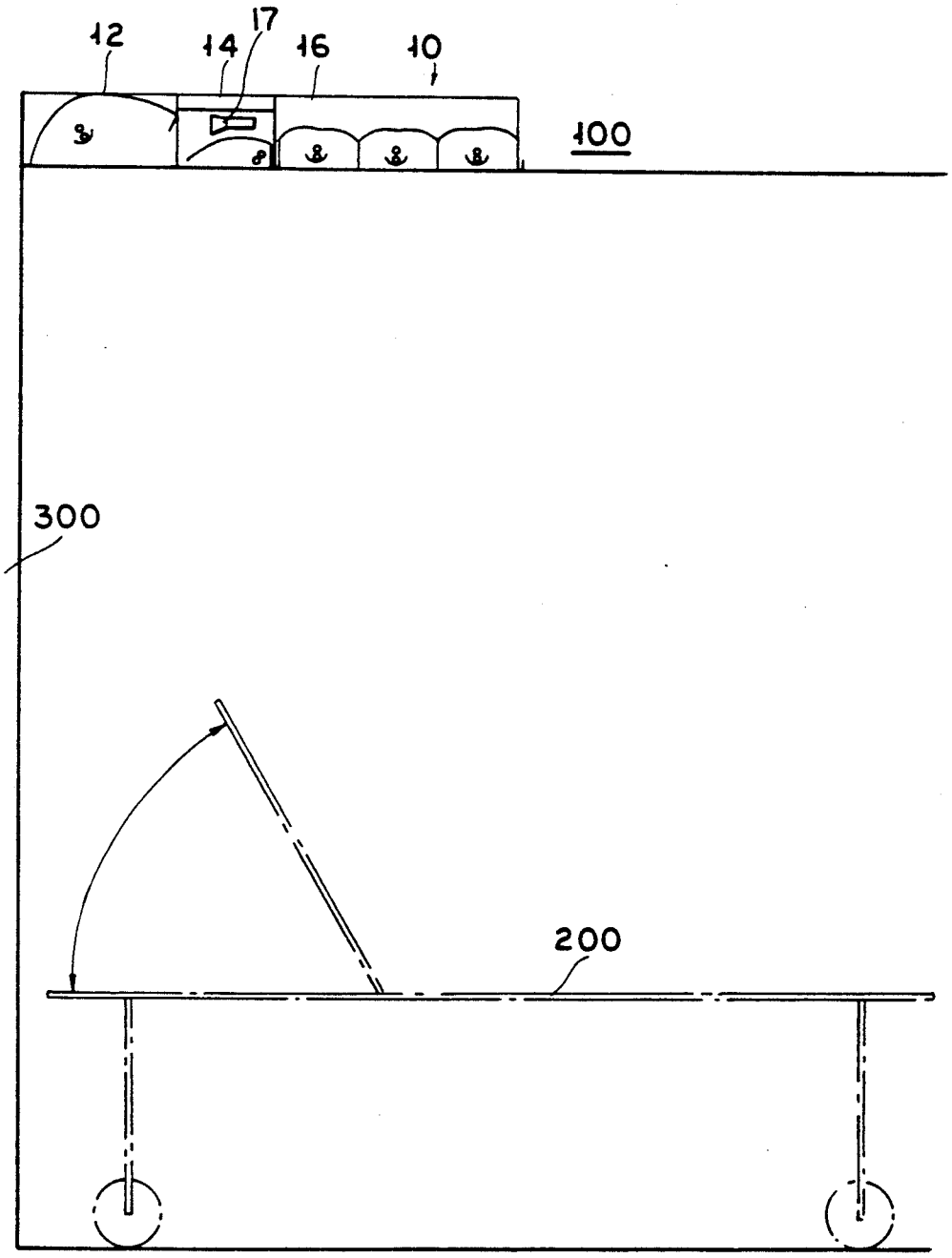
FIG. 1 is a side plan view, partly in cross section, of the modular medical light system of the present invention.
Figure 2:
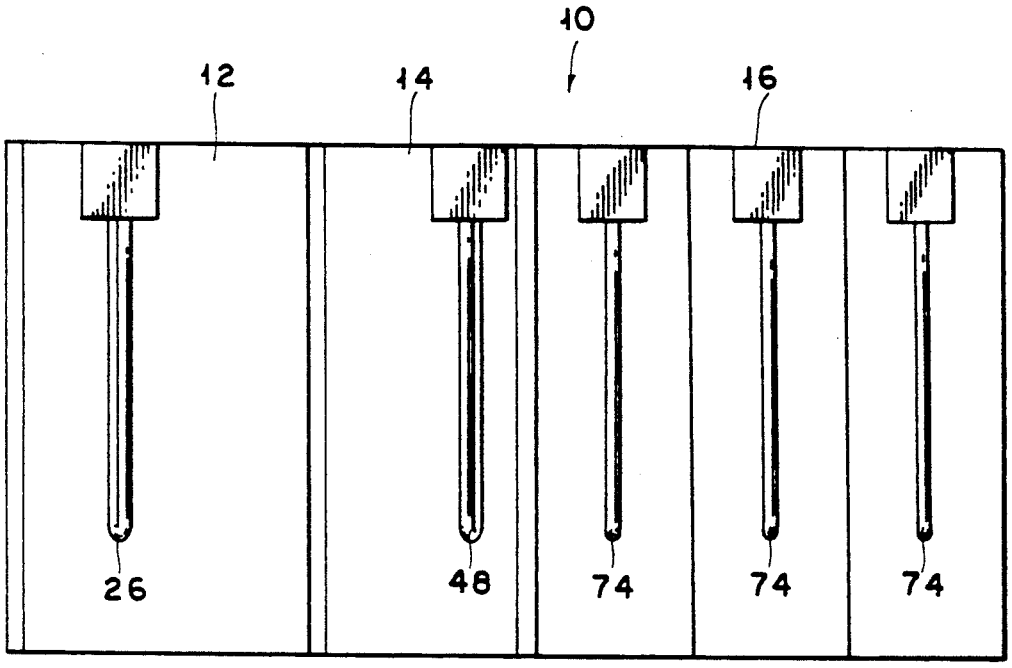
FIG. 2 is a bottom plan view of the modular medical light system of the present invention (with the shields around the fluorescent bulbs removed).

Referring now to the drawings in detail wherein like numerals indicate like elements throughout the several views, FIG. 1 is a side plan view, partly in cross section, of the modular medical lighting system 10 of the present invention while FIG. 2 is a bottom plan view of modular medical lighting system 10. Modular medical lighting system 10 is mounted in ceiling 100, directly over a patient's bed 200, and preferably adjacent to wall 300. Preferably, modular medical lighting is four feet long and two feet wide to conform to standard lighting fixture sizes.

Modular medical lighting system 10, in its complete and preferred embodiment, includes reading light module 12, ambient light module 14, examination light module 16, and night light module 17 (over ambient light module 14). As disclosed in commonly owned U.S. patent application Ser. No. 07/693,696 to issue on even date herewith as U.S. Pat. No. 5,086,375, the reading light module 12, the ambient light module 14, and the examination light module 16 (and by inference, night light module 17) may be integrated into a single light fixture. However, these modules may also be provided separately and placed within a housing. Moreover, as shown in FIGS. 9–12, less than all four modules may be placed within the housing for a limited number of functions to be provided.

Figure 3:
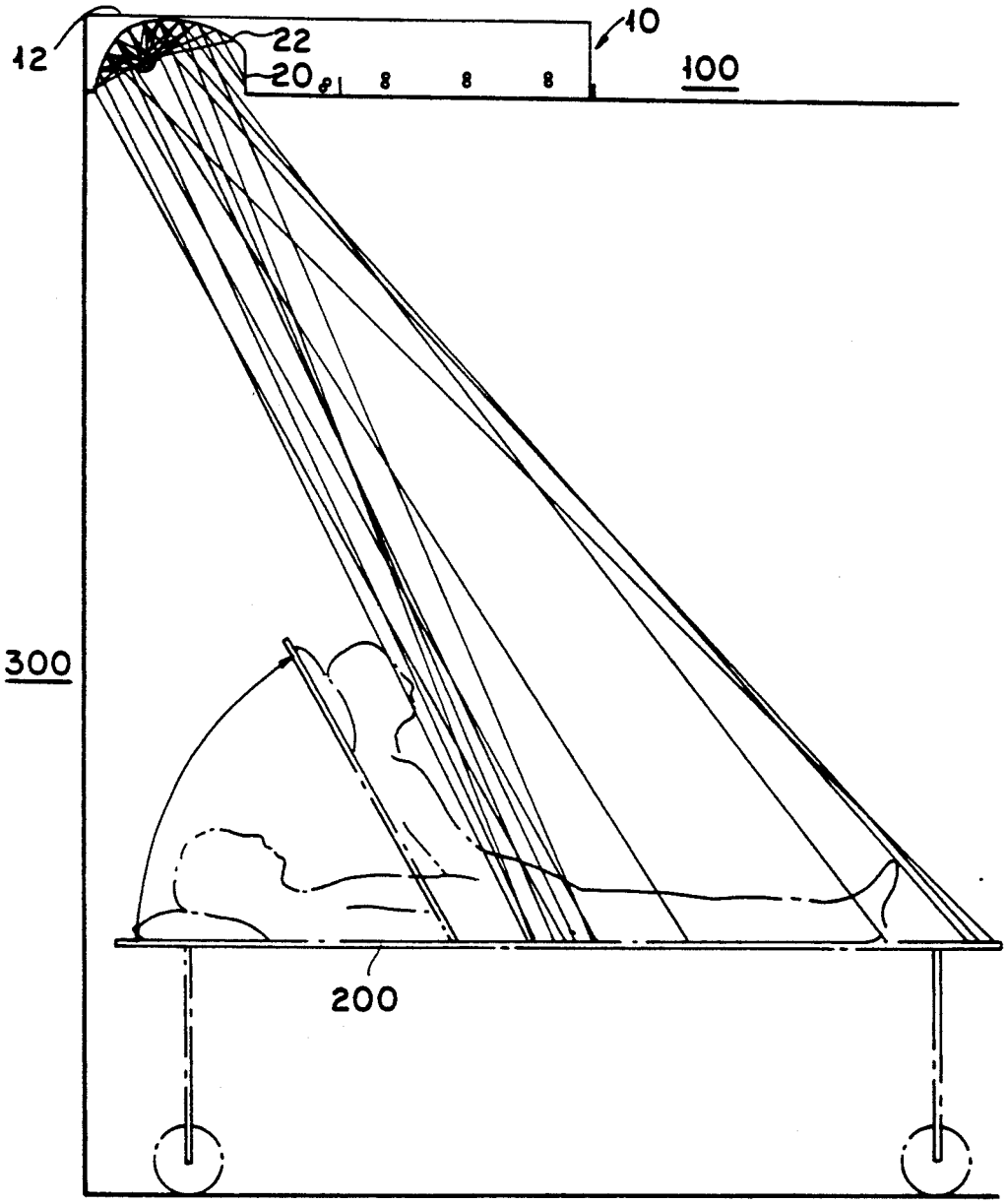
FIG. 3 is a side plan view, partly in cross section, of the modular medical light system showing the area of illumination of the reading light module.

FIG. 3 shows the light distribution pattern of reading light module 12 in relation to the patient reposing upon bed 200. As the light is directed at an angle away from wall 300, the light is not directed into the patient's eyes, regardless of whether the position of the head of bed 200 is in a fully reclining or partially elevated (i.e., a "sitting up" position). Similarly, as the light distribution pattern of reading light module 12 is limited by non-reflective barrier 20, visitors and other people standing proximate to bed 200 are not exposed to glare from reading light module 12.

Figure 4:
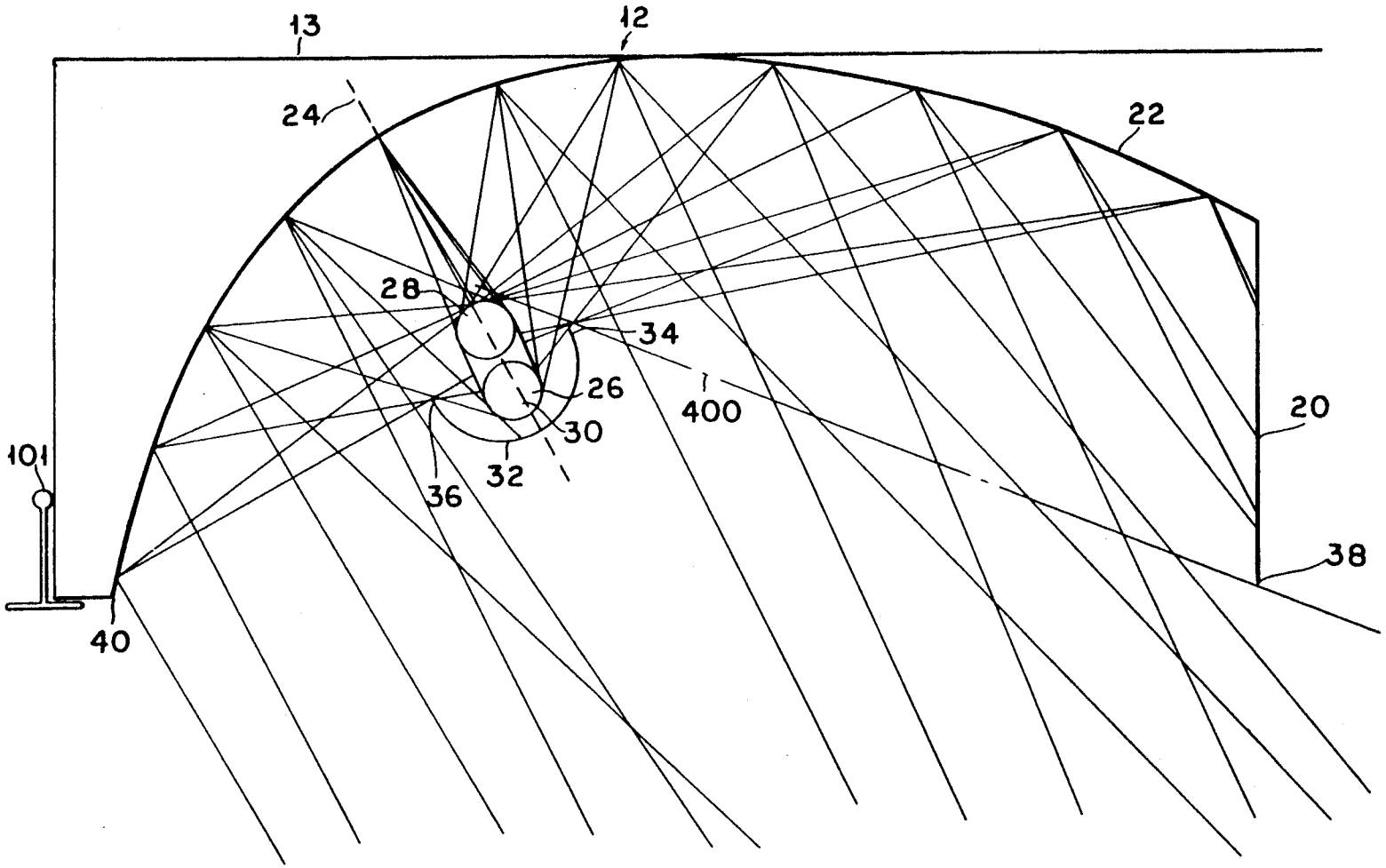
FIG. 4 is a side plan view, partly in cross section, of the reading light module of the modular medical light system.
Figure 10:
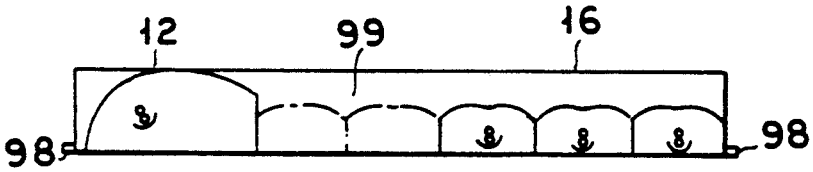
FIG. 10 is a side plan view, partly in cross section, of the reading light module and the patient examination light module, with a blank module or an extended patient examination light module (shown in phantom) therebetween.
Figure 11:
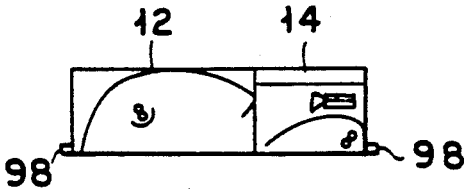
FIG. 11 is a side plan view, partly in cross section, of the reading light module and the ambient light module (including a night light module) of the modular medical light system.

FIG. 4 shows reading light module 12 in more detail. Reading light module 12 includes housing 13 which contains reflector 22. Housing 13 is typically supported by a grid of inverted T-rails 101. Additionally, housing 13 may be supported by a frame or housing 98 as shown in FIGS. 10 and 11 and frame or housing 98 supported by the grid of inverted T-rails 101. Reflector 22 is highly specular and essentially ellipsoidal in shape with an axis 24 inclined so as to direct the light distribution pattern at an angle away from adjacent wall 300. U-shaped bulb 26, preferably a biax® or similar bulb, is placed with the centers of both legs 28 30 intersecting inclined axis 24 so that the light is directed principally away from wall 300. Semi-circular shield 32 is placed around the lower leg 30 of U-shaped bulb 26. Edge 34 of shield 32 is aligned with the lower edge 38 of non-reflective barrier 20, as illustrated by line 400, to prevent uncontrolled direct emanation of glare from bulb 26. Edge 3 of shield 32 is similarly aligned with the lower edge 40 of reflector 22. As will be discussed with regard to FIG. 13, barrier 20 may include an aperture through which light from night light module 17 is directed to a mirror oriented so as to direct the light from night light module 17 to a side of bed 200.

Figure 5:
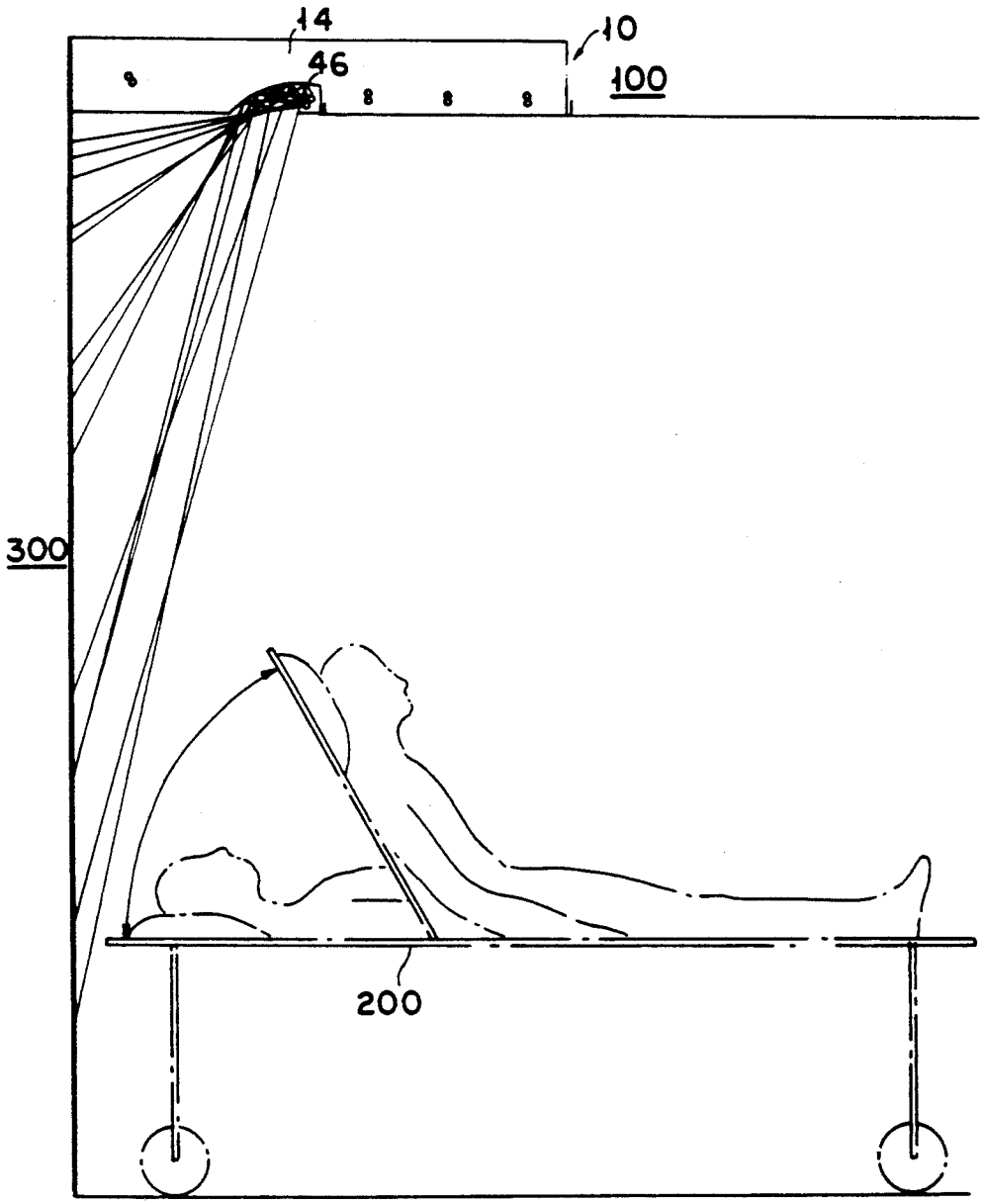
FIG. 5 is a side plan view, partly in cross section, of the modular medical lighting system showing the area of illumination of the ambient light module.

FIG. 5 shows the light distribution pattern of ambient light module 14 in relation to bed 200 and adjacent wall 300. The light is distributed substantially evenly along adjacent wall 300, preferably stopping short of the lowest portions of wall 300, so that the light can diffuse or "wash" from wall 300 thereby providing indirect ambient light to bed 200 and the surrounding area without emanating any substantial glare to the patient or persons standing in the immediate area.

Figure 5A:
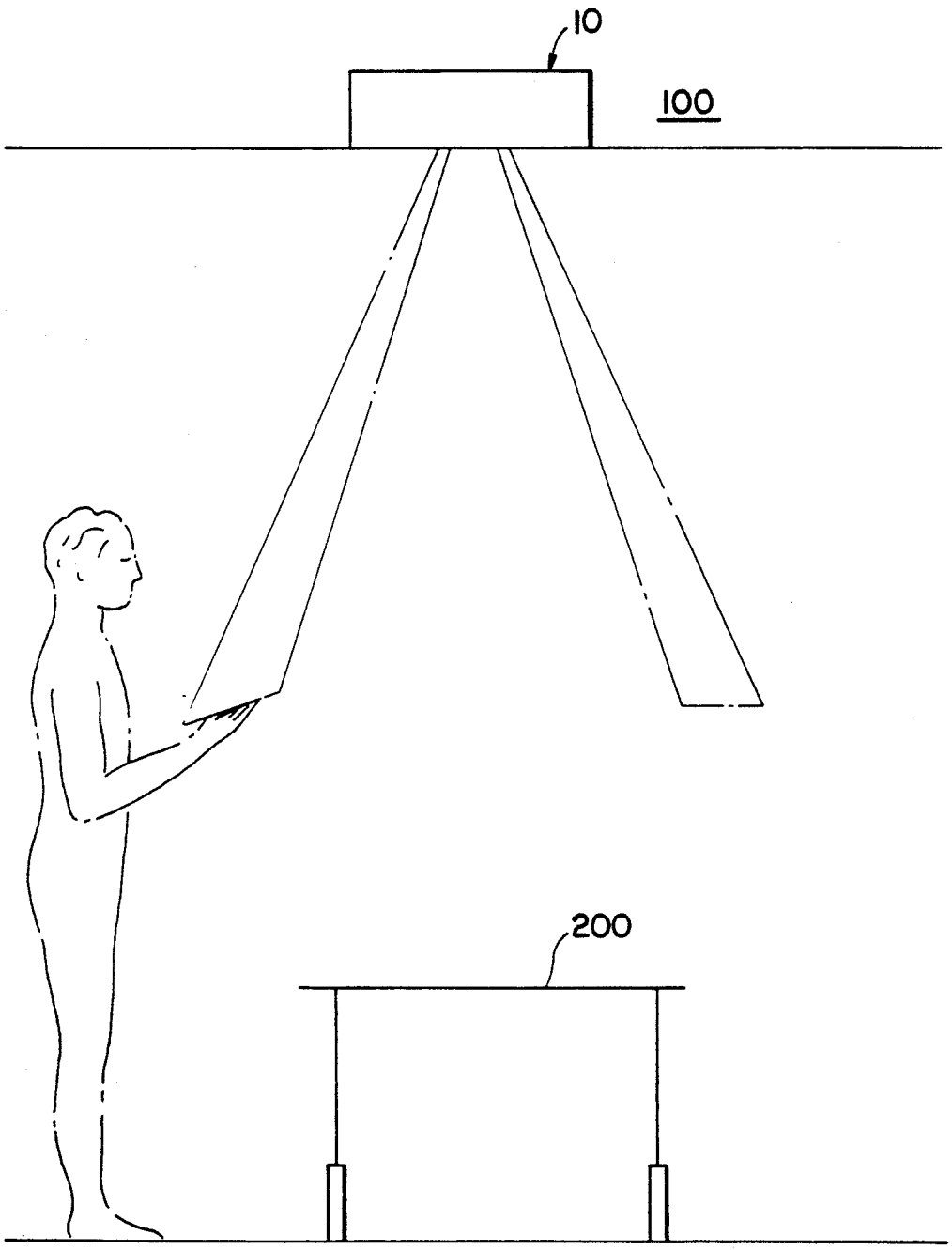
FIG. 5*a* is a front plan view, partly in cross section, of the modular medical lighting system showing the area of illumination of the night light module.

FIG. 5a shows a view from the head of bed 200 showing the light distribution pattern of night light module 17 to either the left or the right of bed 200.

Figure 6:
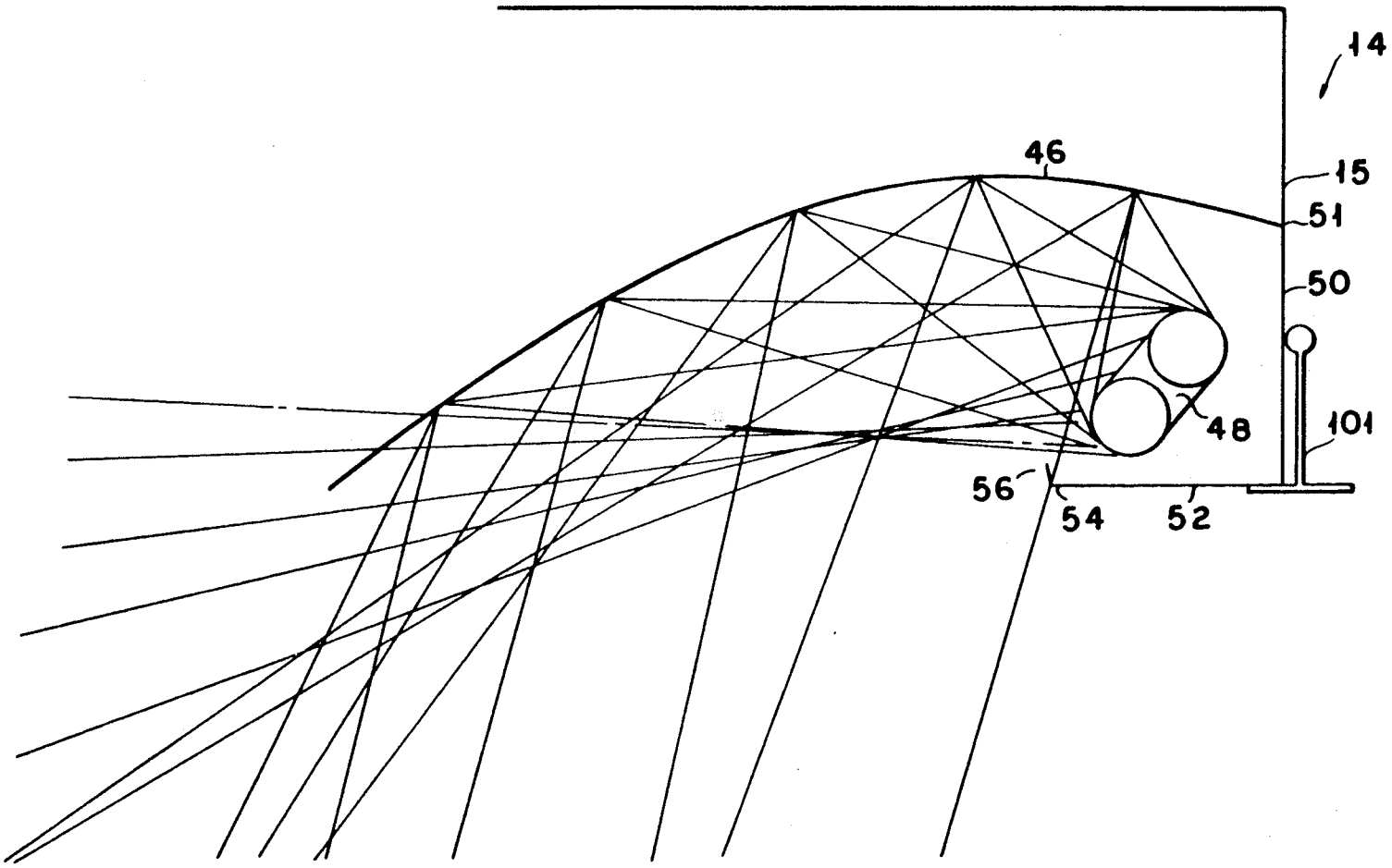
FIG. 6 is a side plan view, partly in cross section, of the ambient light module of the modular medical light system.
Figure 12:
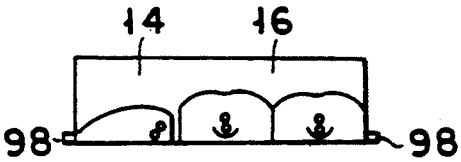
FIG. 12 is a side plan view, partly in cross section, of the ambient light module and the patient examination light module of the modular medical light system.

FIG. 6 shows ambient light module 14 in more detail. Ambient light module 14 includes housing 15 which contains highly specular polished reflector 46. Ambient light module 14 is typically supported by a grid of inverted T-rails 101. Additionally, housing 15 may be supported by a frame or housing 98 as shown in FIGS. 11 and 12 and frame or housing 98 supported by the grid of inverted T-rails. Highly specular polished reflector 46 is formed above and rearwardly from inclined U-shaped bulb 48 (preferably a biax® or similar bulb). The forward edge 51 of reflector 46 joins forward vertical wall 50 which, in turn, joins lower horizontal wall 52. The interior of both vertical wall 50 and horizontal wall 52 are preferably highly reflective white glossy enamel to eliminate hot spots and striping of the reflected light on wall 300. Horizontal wall 52 shields the patient from light directly from bulb 48. Similarly, the rearward edge 54 of horizontal wall 52 includes upwardly extending lip 56 to shield the patient from reflected lamp images.

The position and inclination of U-shaped bulb 48 provide direct light on the uppermost portion of wall 300 whereas the intermediate portion of wall 300 is illuminated by light reflected from reflector 46. As previously stated, preferably the lowest portion of wall 300 is not illuminated by ambient light module 14.

Figure 13:
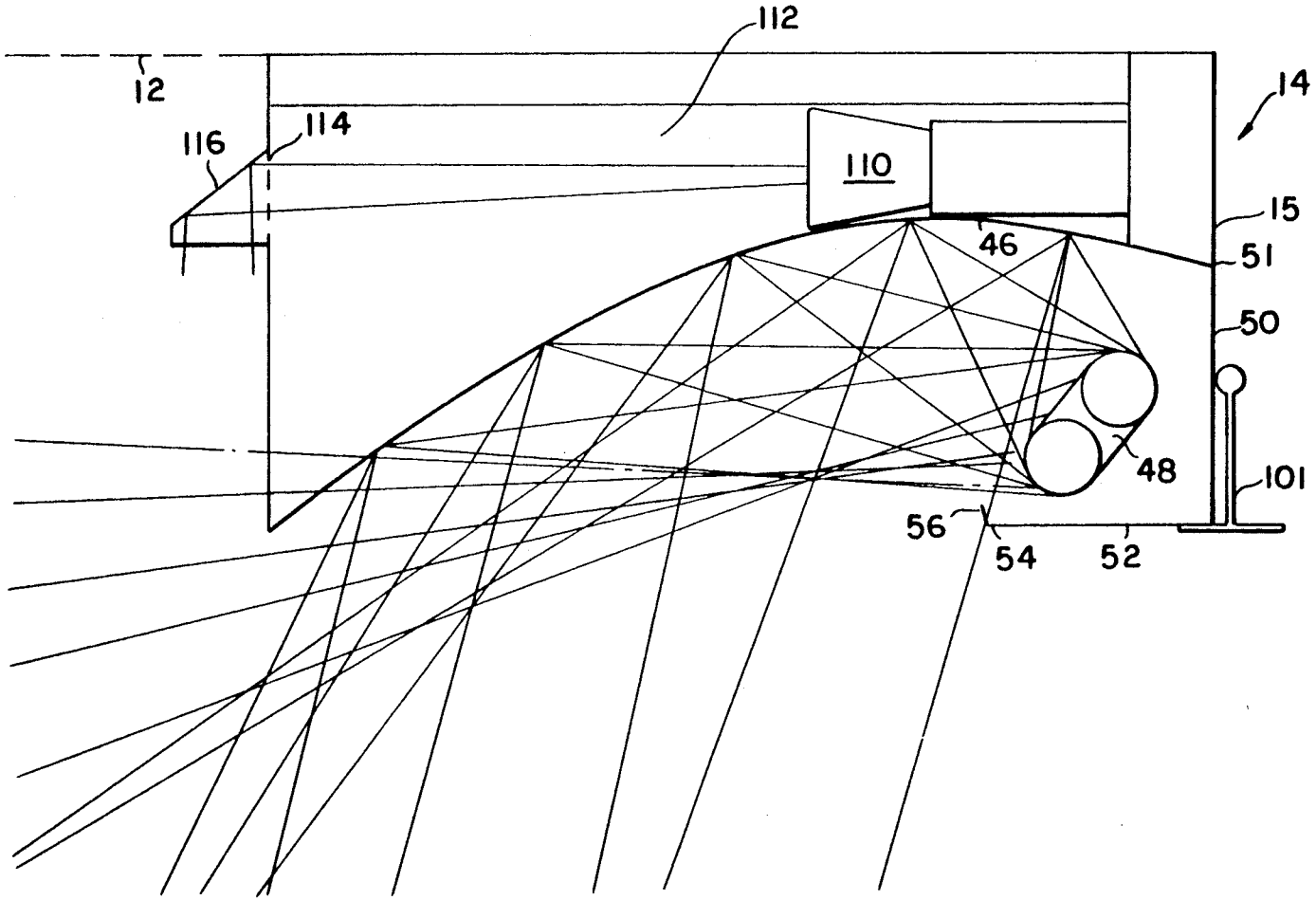
FIG. 13 is a side plan view, partly in cross section, of the night light module of the modular medical light system.

FIG. 13 similarly discloses the ambient light module 14, and additionally discloses the night light module 17 upwardly adjacent to ambient light module 14. Night light module 17 includes horizontally oriented halogen bulb 110 within channel 112. Channel 112 extends to aperture 114 (shown in phantom) and into reading light module ;2 where the light from bulb 110 strikes specular anodized aluminum mirror 116. Mirror 116 is oriented to direct the light downwardly. Additionally, mirror 116 is rotatable about a longitudinal axis of fixture 10 so as to allow the selection of the direction of the light to be on either the left or right side of the bed 200 as shown in FIG. 5a.

Figure 7:
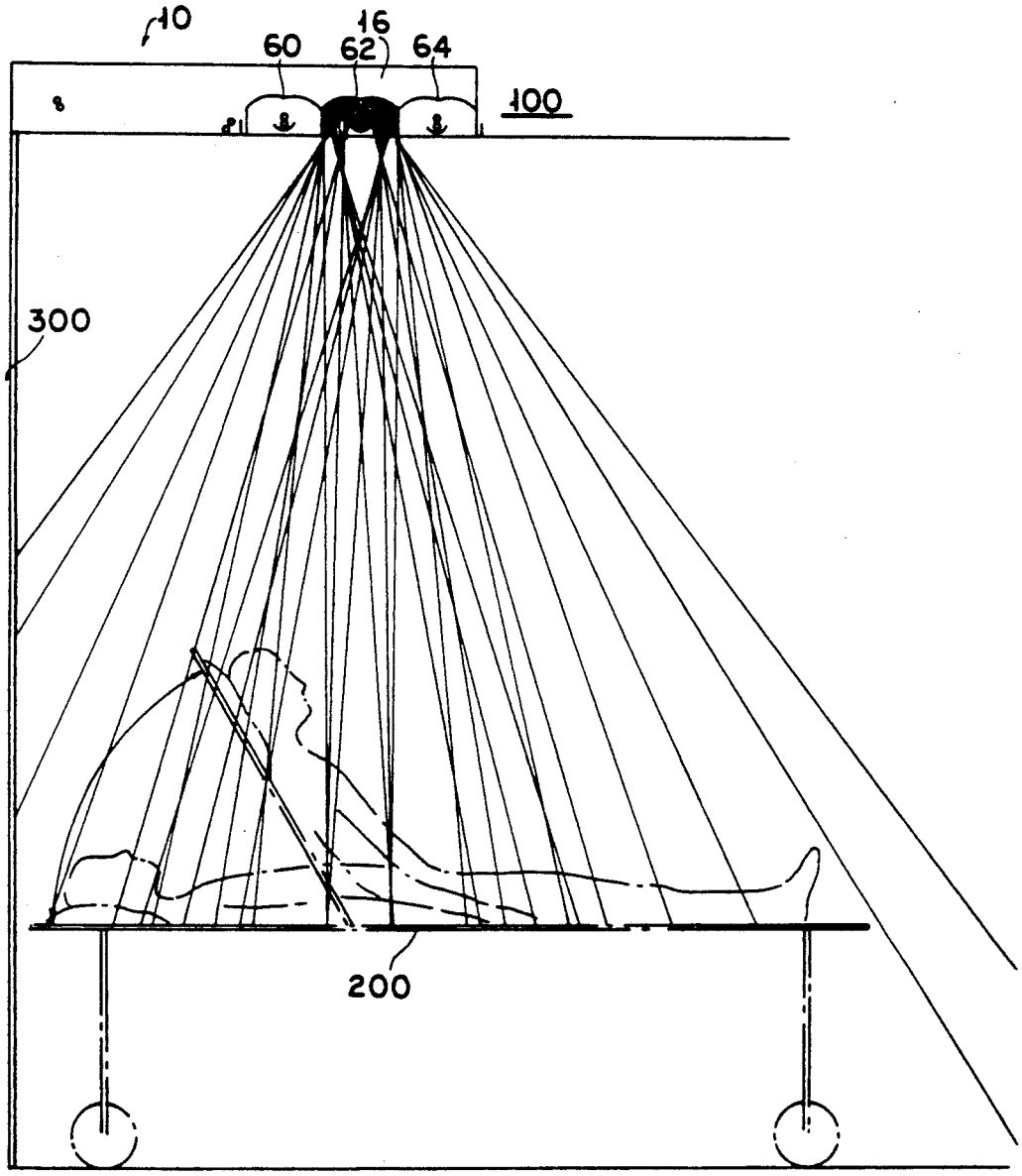
FIG. 7 is a side plan view, partly in cross section, of the modular medical lighting system showing the area of illumination of the patient examination light module.

FIG. 7 shows the light distribution pattern of examination light module 16 in relation to bed 200 and adjacent wall 300. Examination light module 16 preferably includes three substantially identical optical systems 60, 62, 64, but may include any number, including one, of optical systems. A plurality of optical systems allows the illumination intensity of examination light module 16 to be varied as appropriate for the care being administered to the patient.

Figure 8:
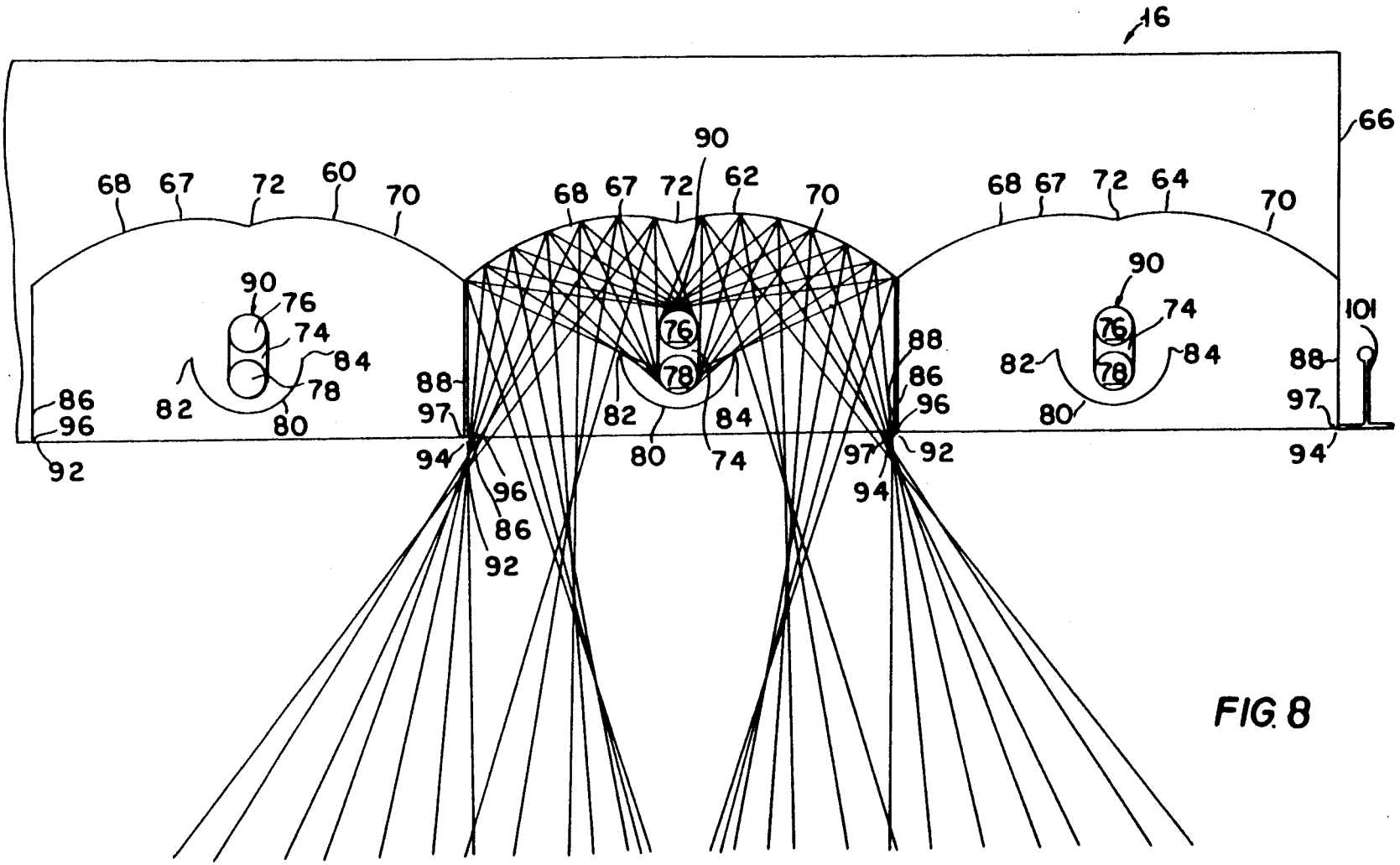
FIG. 8 is a side plan view, partly in cross section, of the patient examination light module of the modular medical light system.

FIG. 8 shows the examination light module 16 in more detail. Examination light module 16 includes housing 66 enclosing optical systems 60, 62, 64. Examination light module 16 is typically supported by a grid of inverted T-rails 101. Additionally, housing 66 may be supported by a frame or housing 98 and frame or housing 98 supported by the grid of inverted T-rails as shown in FIGS. 10 and 12. Each optical system 60, 62, 64 includes highly polished specular reflector 67 with two essentially ellipsoidal contours 68, 70 forming apex 72 therebetween. U-shaped bulb 74, preferably a biax® or similar bulb, is positioned below apex 72 with first leg 76 immediately over second leg 78. Semi-circular shield 80 is positioned under second leg 78 with first and second edges 82, 84 vertically aligned with a central position between first leg 76 and second leg 78 so as substantially to eliminate the direct unreflected and uncontrolled emanation of light from examination light module 16. Outward ends of ellipsoidal contours 68, 70 join vertical non-reflective (preferably black) risers 86, 88.

Ellipsoidal contours 68, 70 are positioned with respect to bulb 74 so that the first focal point of both contours 68, 70 intersect at point 90 immediately above first leg 76. The second focal points 92, 94 of ellipsoidal contours 68, 70 occur immediately below the lower edges 96, 97 of vertical non-reflective risers 86, 88. Moreover, bulb 74 and ellipsoidal contours 68, 70 are configured to direct a beam within the angular limits generally of the patient's bed 200 as shown in FIG. 7.

Figure 9:
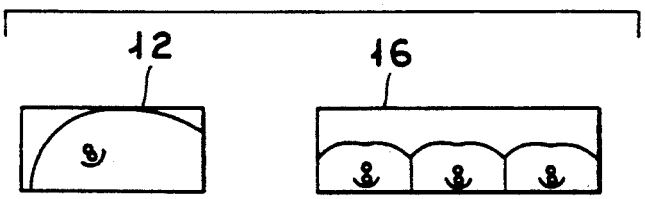
FIG. 9 is a side plan view, partly in cross section, of the reading light module and the examination light module.

FIG. 9 discloses how a reading light module 12 and a patient examination light module 16 can be separately mounted to provide their respective features.

FIG. 10 discloses a reading light module 12 and a patient examination light module 16 mounted on frame or housing 98 with a blank module 99 or additional optical systems (shown in phantom) of examination light module 16 between modules 12 and 16.

Similarly, FIG. 11 discloses a reading light module 12 and an ambient light module 14 (along with night light module 17) in frame or housing 98 and FIG. 12 discloses an ambient light module 14 and an examination light module 16 in frame or housing 98. Additionally, any of modules 12, 14, 16 or 17 (17 typically being incorporated in 14) can be provided as a separate fixture for their respective functions.

Reading light module 12 typically has an illumination value of approximately 70 foot-candles while ambient light module 14 typically has an illumination value of approximately 50 foot-candles and examination light module 16 typically has an illumination value of approximately 100 foot-candles. Night light module 17 typically has an illumination value of 30 foot-candles.

The modular medical lighting system 10, whether provided as a complete system or assembled from individual modules, is recessed or surface mounted on ceiling 100. To use modular medical lighting system 10, the user typically operates an integrated switch mechanism (not shown) either on wall 300 or on a cord (not shown) accessible to the patient and/or medical personnel.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A medical lighting system comprising:

a first light fixture module oriented to direct light downwardly to a selected reading area under the medical lighting system, said first light fixture including a first reflector with an inclined axis, a first bulb generally under said first reflector, a forward wall blocking at least a portion of light reflected from said first bulb by said first reflector, and a first shield under said first bulb aligned with said first reflector and with a lower section of said forward wall to prevent non-reflected light from emanating directly from said first bulb outwardly from said first light fixture module;

a second light fixture module oriented to direct light downwardly and outwardly to a vertical wall surface outwardly adjacent from the medical lighting system whereby light is reflected back to a broad area under the medical lighting system, said second light fixture module including a second reflector, a second bulb forwardly disposed generally under said second reflector, a wall forward of said second reflector, and a horizontal section joining a lower portion of said wall forward of said second reflector, wherein said wall forward of said second reflector and said horizontal section are positioned with respect to said second bulb to directly illuminate uppermost portions of the vertical wall surface from said second bulb and indirectly illuminate intermediate portions of the vertical wall surface by light reflected from said second bulb by said second reflector;

a third light fixture module oriented to direct light downwardly under the medical lighting system to a selected patient examination area under the medical lighting system, said third light fixture module including at least one optical system, each of said optical systems including a third reflector including two substantially ellipsoidal contours forming an apex therebetween, a third bulb directly below said apex, vertical risers at outermost edges of said optical system intersecting with outermost edges of said contours, and a second shield under said third bulb aligned with lower ends of said vertical risers to prevent non-reflected light to emanate directly from said third bulb outwardly from said third light fixture module; and a fourth light fixture module including reflection means oriented to direct light to a selected side of the bed substantially free from directing light onto the bed.

2. The medical lighting system of claim 1 wherein said fourth light fixture module includes a fourth bulb which is upwardly adjacent from said second light fixture module.

3. The medical lighting system of claim 2 wherein said fourth bulb is oriented horizontally over said second reflector of said second light fixture module.

4. The medical lighting system of claim 3 wherein said reflection means includes an obliquely oriented mirror in said first light fixture module and wherein said fourth bulb directs light through an aperture in said forward wall of said first light fixture module so as to reflect from said oblique mirror.

5. The medical lighting system of claim 4 wherein said obliquely oriented mirror is rotatable about a longitudinal axis of the system so as to allow the selection of the direction of light to be chosen from the right side or left side of the system.

6. The medical lighting system of claim 2 wherein said first bulb, said second bulb, and said third bulb are fluorescent bulbs and said fourth bulb is a halogen bulb.

7. The medical lighting system of claim wherein said first bulb, said second bulb, and said third bulb are U-shaped.

8. The medical lighting system of claim 7 wherein said first bulb, said second bulb, and said third bulb are "biax" bulbs.

9. The medical lighting system of claim 1 further including means for engaging a grid of inverted T-shaped rails.

10. A medical lighting system comprising:

a first light fixture module oriented to direct light downwardly and outwardly to a vertical wall surface outwardly adjacent from the medical lighting system whereby light is reflected back to a broad area under the medical lighting system, said first light fixture module including a first reflector, a first bulb forwardly disposed generally under said first reflector, a wall forward of said first reflector, and a horizontal section joining a lower portion of said wall forward of said first reflector, wherein said wall forward of said first reflector and said horizontal section are positioned with respect to said first bulb to directly illuminate uppermost portions of the vertical wall surface from said first bulb and indirectly illuminate intermediate portions of the vertical wall surface by light reflected from said first bulb by said first reflector; and a second light fixture module oriented to direct light downwardly under the medical lighting system to a selected patient examination area under the medical lighting system, said second light fixture module including at least one optical system, each of said optical systems including a second reflector including two substantially ellipsoidal contours forming an apex therebetween, a second bulb directly below said apex, vertical risers at outermost edges of said optical system intersecting with outermost edges of said contours, and a shield under said second bulb aligned with lower ends of said vertical risers to prevent non-reflected light to emanate directly from said second bulb outwardly from said second light fixture module; and a third light fixture module including reflection means oriented to direct light to a selected side of the bed substantially free from directing light onto the bed.

11. The medical lighting system of claim 10 wherein said third light fixture module includes a third bulb which is upwardly adjacent from said first light fixture module.

12. The medical lighting system of claim 11 wherein said third bulb is oriented horizontally over said first reflector of said first light fixture module.

13. The medical lighting system of claim 12 wherein said reflection means includes an obliquely oriented mirror.

14. The medical lighting system of claim 13 wherein said obliquely oriented mirror is rotatable about a longitudinal axis of the system so as to allow the selection of the direction of light to be chosen from the right side or left side of the system.

15. The medical lighting system of claim 11 wherein said first bulb and said second bulb are fluorescent bulbs and said third bulb is a halogen bulb.

16. The medical lighting system of claim 15 wherein said first bulb and said second bulb are U-shaped.

17. The medical lighting system of claim 16 wherein said first bulb and said second bulb are "biax" bulbs.

18. The medical lighting system of claim 10 further including means for engaging a grid of inverted T-shaped rails.

19. A medical lighting system comprising:

a first light fixture module oriented to direct light downwardly to a selected reading area under the medical lighting system, said first light fixture including a first reflector with an inclined axis, a first bulb generally under said first reflector, a forward wall blocking at least a portion of light reflected from said first bulb by said first reflector, and a first shield under said first bulb aligned with said first reflector and with a lower section of said forward wall to prevent non-reflected light from emanating directly from said first bulb outwardly from said first light fixture module; and a second light fixture module oriented to direct light downwardly under the medical lighting system to a selected patient examination area under the medical lighting system, said second light fixture module including at least one optical system, each of said optical systems including a second reflector including two substantially ellipsoidal contours forming an apex therebetween, a second bulb directly below said apex, vertical risers at outermost edges of said optical system intersecting with outermost edges of said contours, and a second shield under said second bulb aligned with lower ends of said vertical risers to prevent non-reflected light to emanate directly from said second bulb outwardly from said second light fixture module;

a third light fixture module including reflection means oriented to direct light to a selected side of the bed substantially free from directing light onto the bed.

20. The medical lighting system of claim 19 wherein said third light fixture module includes a third bulb which is oriented horizontally.

21. The medical lighting system of claim 20 wherein said reflection means includes an obliquely oriented mirror.

22. The medical lighting system of claim 21 wherein said obliquely oriented mirror is rotatable about a longitudinal axis of the system so as to allow the selection of the direction of light to be chosen from the right side or left side of the system.

23. The medical lighting system of claim 20 wherein said first bulb and said second bulb are fluorescent bulbs, and said third bulb is a halogen bulb.

24. The medical lighting system of claim 23 wherein said first bulb and said second bulb are U-shaped.

25. The medical lighting system of claim 24 wherein said first bulb and said second bulb are "biax" bulbs.

26. The medical lighting system of claim 19 further including means for engaging a grid of inverted T-shaped rails.

27. A medical lighting system comprising:

a first light fixture module oriented to direct light downwardly to a selected reading area under the medical lighting system, said first light fixture including a first reflector with an inclined axis, a first bulb generally under said first reflector, a forward wall blocking at least a portion of light reflected from said first bulb by said first reflector, and a first shield under said first bulb aligned with said first reflector and with a lower section of said forward wall to prevent non-reflected light from emanating directly from said first bulb outwardly from said first light fixture module;

a second light fixture module oriented to direct light downwardly and outwardly to a vertical wall surface outwardly adjacent from the medical lighting system whereby light is reflected back to a broad area under the medical lighting system, said second light fixture module including a second reflector, a second bulb forwardly disposed generally under said second reflector, a wall forward of said second reflector, and a horizontal section joining a lower portion of said wall forward of said second reflector, wherein said wall forward of said second reflector and said horizontal section are positioned with respect to said second bulb to directly illuminate uppermost portions of the vertical wall surface from said second bulb and indirectly illuminate intermediate portions of the vertical wall surface by light reflected from said second bulb by said second reflector;

a third light fixture module including reflection means oriented to direct light to a selected side of the bed substantially free from directing light onto the bed.

28. The medical lighting system of claim 29 wherein said third light fixture module includes a third bulb which is upwardly adjacent from said second light fixture module.

29. The medical lighting system of claim 28 wherein said third bulb is oriented horizontally over said second reflector of said second light fixture module.

30. The medical lighting system of claim 29 wherein said reflection means includes an obliquely oriented mirror in said first light fixture module and wherein said third bulb directs light through an aperture in said forward wall of said first light fixture module so as to reflect from said oblique mirror.

31. The medical lighting system of claim 30 wherein said obliquely oriented mirror is rotatable about a longitudinal axis of the system so as to allow the selection of the direction of light to be chosen from the right side or left side of the system.

32. The medical lighting system of claim 28 wherein said first bulb and said second bulb are fluorescent bulbs, and said third bulb is a halogen bulb.

33. The medical lighting system of claim 32 wherein said first bulb and said second bulb are U-shaped.

34. The medical lighting system of claim 33 wherein said first bulb and said second bulb are "biax" bulbs.

35. The medical lighting system of claim 27 further including means for engaging a grid of inverted T-shaped rails.

* * * * *